United States Patent [19]

Misevich et al.

[11] Patent Number: 4,854,057

[45] Date of Patent: Aug. 8, 1989

[54] DYNAMIC SUPPORT FOR AN ATHLETIC SHOE

[75] Inventors: Kenneth W. Misevich, Fairfield, Conn.; Rob R. McGregor, Concord, Mass.; Anthony J. Corrao, Lewiston, Me.

[73] Assignee: Tretorn AB, Helsingborg, Sweden

[21] Appl. No.: 223,671

[22] Filed: Jul. 15, 1988

Related U.S. Application Data

[63] Continuation of Ser. No. 878,066, Jun. 24, 1986, abandoned, which is a continuation of Ser. No. 456,820, Jan. 10, 1983, abandoned, which is a continuation-in-part of Ser. No. 347,632, Feb. 10, 1982, abandoned.

[51] Int. Cl.[4] ..... A43B 5/00; A43B 5/06; A43B 13/42

[52] U.S. Cl. ..... 36/114; 36/30 R; 36/31; 36/107; 36/129; 128/614

[58] Field of Search ..... 36/114, 129, 103, 30 R, 36/32 R, 76 C, 108, 107, 30 A, 44, 104, 31; 128/614–618

[56] References Cited

U.S. PATENT DOCUMENTS

| | | | |
|---|---|---|---|
| 1,239,575 | 9/1917 | Donnelly | 128/614 |
| 2,601,509 | 6/1952 | Fisher | 128/617 |
| 3,300,880 | 1/1967 | Campagna . | |
| 3,414,988 | 12/1968 | Mattos . | |
| 3,416,245 | 12/1968 | Ferreira . | |
| 3,566,486 | 3/1971 | Conway | 36/114 |
| 3,785,648 | 1/1974 | Ruskin . | |
| 4,107,857 | 8/1978 | Devlin . | |
| 4,128,950 | 12/1978 | Bowerman et al. . | |
| 4,231,169 | 11/1980 | Toyama et al. | 36/76 C |
| 4,241,523 | 12/1980 | Daswick | 36/30 R |
| 4,297,796 | 11/1981 | Stirtz et al. . | |
| 4,314,413 | 2/1982 | Dassler | 36/104 |
| 4,364,189 | 12/1982 | Bates | 36/31 |
| 4,378,642 | 4/1983 | Light et al. . | |
| 4,391,048 | 7/1983 | Lutz | 36/30 R |
| 4,481,726 | 11/1984 | Phillips | 36/30 A |
| 4,561,197 | 12/1985 | Misevich . | |

FOREIGN PATENT DOCUMENTS

| | | | |
|---|---|---|---|
| 69126 | 8/1981 | Australia . | |
| 28428 | 6/1939 | Brazil . | |
| 4336171 | 7/1971 | Brazil . | |
| 60255 | 6/1975 | Brazil . | |
| 5700649 | 6/1977 | Brazil . | |
| 7902612 | 4/1979 | Brazil . | |
| 2164316 | 6/1973 | Fed. Rep. of Germany | 36/44 |
| 2802197 | 7/1979 | Fed. Rep. of Germany | 36/107 |
| 20908 | of 1892 | United Kingdom | 36/30 R |
| 473207 | 10/1937 | United Kingdom | 128/616 |
| 508689 | 7/1939 | United Kingdom . | |
| 522866 | 6/1940 | United Kingdom . | |
| 600613 | 4/1948 | United Kingdom . | |
| 842720 | 7/1960 | United Kingdom . | |
| 1436501 | 5/1976 | United Kingdom . | |
| 1438009 | 6/1976 | United Kingdom . | |
| 1550954 | 8/1979 | United Kingdom . | |
| 1594908 | 8/1981 | United Kingdom . | |
| 2097650 | 11/1982 | United Kingdom . | |

OTHER PUBLICATIONS

*The Running Shoe Book* by Peter R. Cavanagh, Published 1980 by Anderson World, Inc., pp. 183, 184.

*Primary Examiner*—James Kee Chi
*Attorney, Agent, or Firm*—Donald Brown

[57] ABSTRACT

An athletic running shoe having a polymeric foamed midsole and a special stiffening formation formed separately of the midsole and received between two layers of the midsole to reduce non-uniform midsole degradation.

10 Claims, 2 Drawing Sheets

DYNAMIC SUPPORT FOR AN ATHLETIC SHOE

This application is a continuation of application Ser. No. 878,066, filed June 24, 1986, now abandoned, which is a continuation of Ser. No. 456,820, filed Jan. 10, 1983 now abandoned, which is a continuation-in-part of application Ser. No. 347,632, filed on Feb. 10, 1982, now abandoned.

FIELD OF INVENTION

This invention relates to athletic shoes and is particularly concerned with running or jogging shoes of the type having a closed cell polymeric foamed midsole.

BACKGROUND

Present day sliplasted and boardlasted running and jogging shoes, as well as other types of athletic shoes, are customarily manufactured with a laminate bottom construction having a closed cell polymeric foam midsole overlying and adhered to a flexible outsole. Sliplasted athletic running shoes mainly differ from boardlasted athletic shoes in that they have no insole board and instead have a closed fabric bottom to extend completely around the foot like a slipper. In the boardlasted athletic running shoes, the upper has an open bottom which is closed by an insole board overlying the midsole. The foamed midsole is used in both types of shoes because of its lightness and shock absorbing properties to cushion the wearer's foot against impacts during running.

Sliplasted athletic shoes are generally preferred over boardlasted athletic shoes because they usually are more comfortable than boardlasted athletic shoes. Due to the absence of an insole board, however, sliplasted athletic shoes are usually less stable than boardlasted athletic shoes because concentrated stresses are developed in the foamed midsole during running to nonuniformly degrade the foamed midsole to an objectionable extent. The foamed midsole therefore loses much of its effectiveness as a shock absorber because of the non-uniform degradation.

Degradation of the foamed midsole arises from continual stresses which are developed by the repeated and cyclic deformation and relaxation of the midsole during the course of running. The degradation may take the form of a permanent compressive deformation or compression set, as it is called, of the midsole. Degradation may also occur without compression set where there is a breakdown or loss of the closed cells in the foamed midsole. One cause of such a cellular breakdown is the lateral outward expansion of the midsole due to compressive forces acting on the midsole.

Midsole degradation is frequently localized due to concentrated force patterns in the midsole's impact absorbing regions, particularly in the heel or rearfoot region under the wearer's calcaneus. Concentrated force patterns may also be set up in other regions due to a runner's particular running style. For example, localized midsole degradation may occur at the rear outside border of the shoe in the region of the back of the heel.

Localized midsole degradation along either the medial inside or lateral outside shoe edges under the heel is particularly troublesome because it tends to cause the shoe to lose its stability by tilting as the runner's foot strikes the ground. To compensate for the instability, the runner may adjust his running style which, in turn, could lead to foot or ankle injuries. Furthermore, the problem of midsole degradation is compounded by the fact that it frequently occurs before the outsole loses its service life.

The foamed midsole in a boardlasted athletic running shoe will also degrade as a result of usage, but the degradation is not as nonuniform as the midsole degradation in a slip-lasted athletic shoe because the insole board of the boardlasted athletic shoe more uniformly distributes the forces acting on the midsole to some extent as long as the insole board itself does not degrade.

Although an insole board does distribute the forces acting on the foamed midsole to some extent, it was found that if the insole board is made stiff enough to adequately spread the forces over the foamed midsole, the shoe becomes too hard, causing appreciable discomfort to the wearer. On the other hand, a low strength insole board which meets the wearer's comfort requirements is likely to degrade, thus giving rise to excessive nonuniform degradation even in boardlasted shoes.

SUMMARY AND OBJECTS OF INVENTION

With the foregoing in mind, the general aim and purpose of this invention is to provide a novel structure for improving the stability of the athletic shoe, reducing midsole degradation, and enhancing the anatomical support for the wearer's foot, all without making the shoe uncomfortably hard and without using any parts which reduce the foot-receiving volume of the upper.

A more specific aim and purpose of this invention is to provide a novel structure for substantially reducing the nonuniform midsole degradation of a sliplasted athletic shoe without resorting to an insole board and without otherwise impairing the comfort properties of a sliplasted athletic shoe.

In accordance with this invention, nonuniform midsole degradation is reduced by placing a stiff, preformed midsole stiffening formation between upper and lower layers of the midsole. In the illustrated embodiment the preformed stiffening formation takes the form of a noncompressible, non-stretchable force-dispersing plate or board, as it may be called. The force-dispersing stiffening plate extends throughout and appreciably beyond the regions where major force concentrations usually develop under the wearer's rearfoot and is stiff enough so that it will not deflect to any significant extent under normal loads. The plate therefore distributes the wearer's load more uniformly, causing a more uniform compression of the underlying midsole layer and thus significantly reducing, if not substantially eliminating, nonuniform degradation of the underlying midsole layer. As a result, the shoe remains stable even after long usage.

Because the force-dispersing plate stiffens the foamed midsole support underneath the foot, its geometrical shape is particularly important. In the illustrated embodiment, the shape of the plate is such that it underlies the wearer's entire rearfoot region and extends forwardly approximately to the first, second and third metatarsal heads to underlie the inside arch, but not the outside arch of the wearer's midfoot. As a result, the plate does not interfere with the required flexure of the shoe. It therefore may be made as stiff as possible but not so stiff that it becomes brittle.

The force-dispersing stiffening plate of this invention separates and is advantageously glued or otherwise adhered to the upper and lower midsole layers. Because the plate is non-stretchable, the adherence of the plate to the opposing midsole layers by itself has the effect of restraining the outward lateral expansion of the midsole due to compressive forces, thereby reducing midsole degradation due to such outward expansion.

By making the force-dispersing plate stiff enough so that it will not deflect to any significant extent under a typical peak heel load, the foamed midsole layer underlying the plate will act almost solely as a shock absorber to absorb forces resulting from the impact of the foot on the ground. The midsole layer overlying the plate also absorbs shock and additionally cushions the wearer's foot so that the shoe does not feel hard due to the presence of the plate. Furthermore, the foamed midsole layer overlying the plate is preferably of sufficient thickness to cup and closely conform to the shape of the wearer's heel, thereby enhancing the comfort qualities of the shoe.

By selectively increasing the stiffness of the foamed midsole, the force-dispersing stiffening plate has the advantageous effect of reducing the extent of penetration of the runner's foot into the midsole. Furthermore, the extension of the plate into the region underlying the wearer's inside or medial arch-supporting region of the midsole, establishes a comfortable dynamic arch support. This aspect of the invention eliminates the need for arch cookies or other conventional arch supporting inserts which disadvantageously reduce the foot-receiving volume of the shoe upper.

The midsole stiffening formation of this invention may advantateously be manufactured separately from the shoe as a customized product for use by podiatrists and orthopaedists in modifying existing running shoes to compensate for leg and foot asymmetries or other problems. Heretofore, various shoe inserts, such as heel cushions, arch supports and other so-called orthotic devices, have been used for this purpose. They all have the common disadvantage of causing some discomfort because they take up foot-receiving space in the shoe upper.

In contrast to these prior shoe inserts, the stiffening formation of this invention lies in the midsole, and not in the upper so that the full volume of the upper remains available for comfortably covering the wearer's foot.

With the foregoing in mind, a further object of this invention is to provide an athletic shoe with a novel midsole unit wherein a special formation engages the foamed midsole body to reduce or retard deleterious, nonuniform degradation of the foamed midsole.

A more specific object of this invention resides in the provision of a novel midsole construction wherein a stiff formation lies between and is adhered to two foamed midsole layers for more uniformly distributing the wearer's load at least in the region underlying the heel to reduce nonuniform degradation of the underlying midsole layer and also to reduce midsole degradation due to outward expansion of the midsole under the influence of the wearer's load.

Yet another object of this invention is to provide an athletic shoe with a novel midsole having a dynamic arch support.

Another object of this invention is to provide an athletic shoe with a novel, economical midsole construction which is easy to manufacture and which achieves the objects mentioned above.

Still another object of this invention is to provide a novel, customized formation for modifying existing athletic shoes for the purpose of accomodating a wearer's particular anatomy or asymmetries.

Yet another object of this invention resides in a novel method of utilizing the customized, shoe-modifying formation mentioned above to compensate for different body weights and/or different leg lengths.

Further objects of this invention will appear as the description proceeds in connection with the below-described drawings and the appended claims.

DETAILED DESCRIPTION

In this specification, the term "rearfoot" is used to identify the heel portion of the foot containing the heel bone (the calcaneus) and the talus, the term "midfoot" is used to identify the intermediate portion of the foot lying between the rearfoot and forefoot and containing the cuboid, the navicular and the cuneiforms, and the term "forefoot" is used to identify the foot portion lying forwardly of the midfoot and containing the metatarsals and the toes. A foamed heel wedge or heel lift, if incorporated into the shoe bottom (i.e., the midsole/outsole unit), is considered to be part of the midsole.

Although the force-dispersing stiffening plate of this invention is incorporated into a sliplasted athletic running shoe in the illustrated embodiment, it will be appreciated that the principles of the subject invention are also applicable to other types of athletic shoes including those having an insole board where the insole board is made sufficiently flexible so that it does not impair the functions of the plate.

Figure 1:
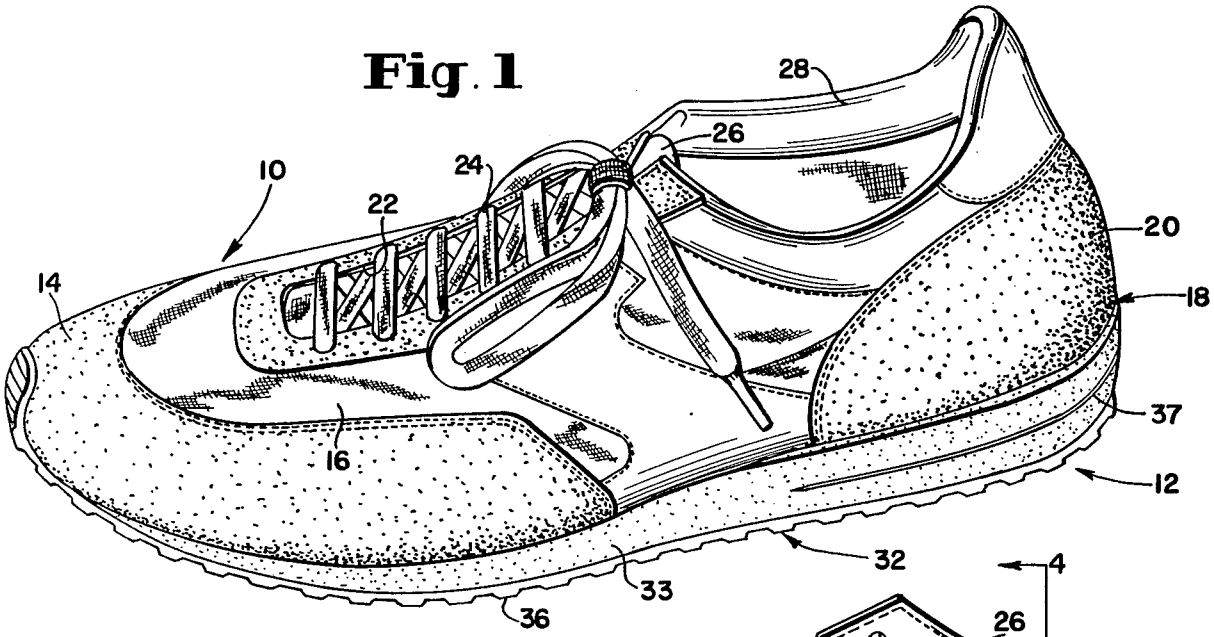
FIG. 1 is a perspective view of a left-hand athletic running shoe incorporating the principles of this invention.
Figure 2:
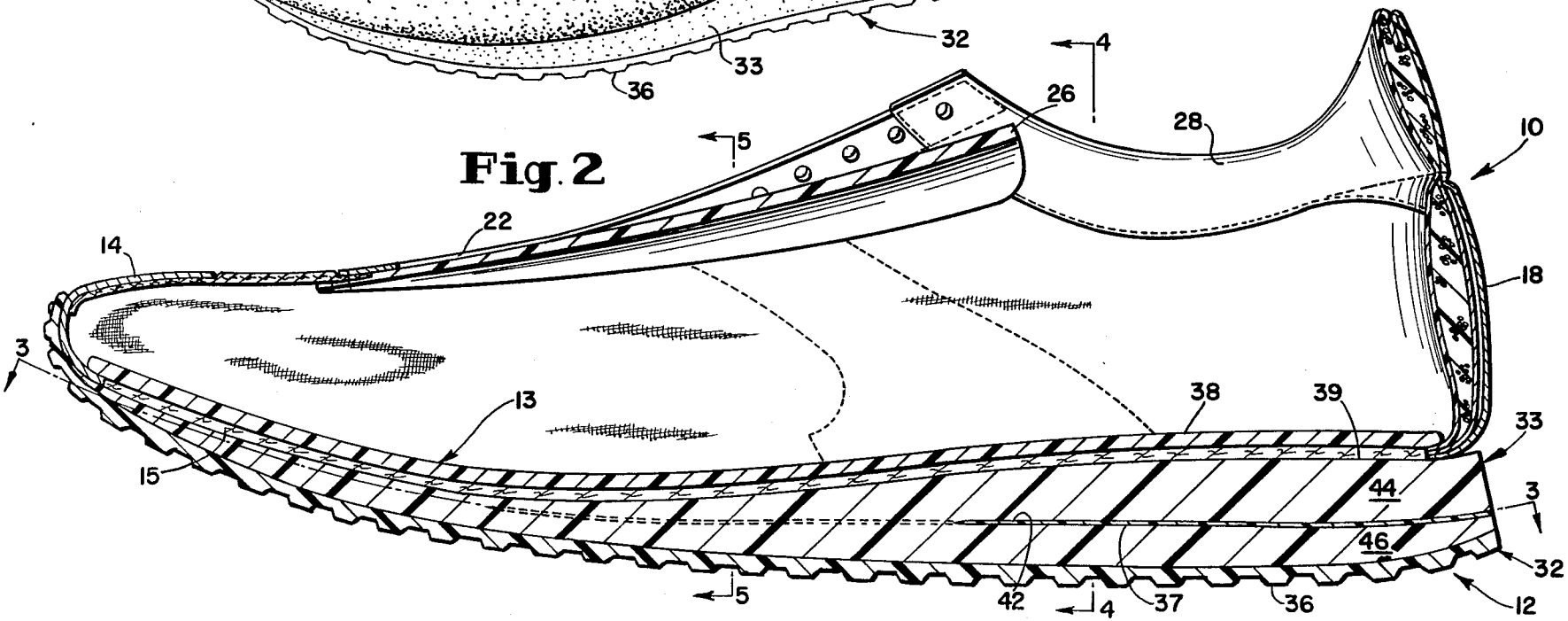
FIG. 2 is a longitudinal section of the athletic running shoe showin in FIG. 1.

Referring to FIGS. 1 and 2, the athletic running shoe incorporating the principles of this invention comprises a flexible, sliplasted upper 10, a bottom 12 underlying the upper 10 and a soft, pliable sliplasted insole 13 (see FIG. 2). Upper 10 has a closed fabric bottom 15 so that it extends completely around the foot in the customary manner. Insole 13 is received in upper 10 and overlies the fabric bottom 15.

The upper 10 may be of any suitable, conventional construction and is shown to comprise a toe portion or toe box 14, a vamp portion 16, a heel portion 18, counter cover 20 wrapped around the back of the heel portion, a throat 22 extending along the vamp portion 16 for the lacing which is indicated at 24, a padded tongue 26 extending along throat 22, and a padded collar 28 extending around the shoe's foot-receiving opening.

The shoe bottom 12 is a laminated construction having a flexible, ground-engaging outsole 32 and a shock-absorbing midsole 33 overlying and bonded to the outsole 32. The outsole 32 may be of any suitable construction and may be fabricated from synthetic or natural rubber material. The ground-engaging surface of outsole 32 is preferably formed with a suitable tread pattern 36. The midsole 33 is substantially coextensive with the outsole 32. The upper 10 is bonded or otherwise suitably secured to midsole 33 along its fabric bottom 15.

The midsole 33 is formed from any suitable closed cell polymeric foam shock absorbing material. For example, the midsole 33 may be formed from a blend of ethylene vinyl acetate and polyethylene and then cross-linked with a peroxide during molding. The foamed material is preferably lightweight having a density on the order of 0.2 grams per cubic centimeter or somewhat less.

Midsole 33 is the thickest at its rearfoot or heel portion 39 where it underlies the wearer's heel or rearfoot. In the illustrated embodiment, the midsole's heel portion 39 is of substantially uniform thickness. Midsole 33 tapers forwardly at an intermediate region lying forwardly of the heel portion 39 to form a wedge as shown in FIGS. 1 and 2. The wedge may be formed separately of the main midsole body, and it may overlie or underlie the main midsole body.

In the illustrated embodiment, the insole 13 comprises a soft, flexible, flat cushion liner 38 for the wearer's sock. Liner 38 overlies the fabric bottom 15 of upper 10 and may be formed from any suitable pliable material such as a foam material or terrycloth. Insole 13 is characterized by the fact that it does not have an insole board.

In the illustrated embodiment, the force-dispersing stiffening formation of this invention is in the form of a preformed, flat-sided dynamic reaction plate 37 or stiffening board, as it may also be called. The plate 37 is formed separately of the foamed midsole 33 and is incorporated into the midsole in a manner to be described below. Plate 37 is planar and relatively thin.

As shown in FIGS. 1–5, plate 37 is received in a slit 42 which is formed in midsole 33 between the upper and lower surfaces of the midsole to partially divide midsole 33 into upper and lower layers 44 and 46, respectively. Plate 37 is glued or otherwise suitably adhered to the bottom surface of the midsole layer 44 and to the upper surface of the lower midsole layer 46. Any suitable adhesive may be used for adhering plate 37 to the midsole layers 44 and 46. Preferably, the adhesive is applied throughout the entire interface between plate 37 the midsole layer 44 and also throughout the entire interface between the plate 37 and lower midsole layer 46. Midsole layers 44 and 46 are separated and spaced apart from each other by plate 37. Slit 42 extends parallel to or at least generally parallel to the outsole 32 when the shoe bottom is in its straight, unflexed condition.

With the possible exception of the midsole's rearmost heel which may be tapered as shown in FIG. 2, the lower midsole layer 46 is provided with a substantially uniform thickness throughout the length and width of slit 42. The rearfoot section the upper midsole layer 44 underlying the wearer's rearfoot or heel also has a substantially uniform thickness.

Midsole layer 44 is preferably thick enough to keep the wearer's foot from bottoming on plate 37 and to keep the wearer from feeling plate 37 during maximum expected impact on the midsole. At a region centrally underlying the wearer's rearfoot or heel, for example, the thickness of the upper midsole layer 44 may be about 15 irons and the thickness of the lower midsole layer 46 may be about 24 irons.

Figure 3:
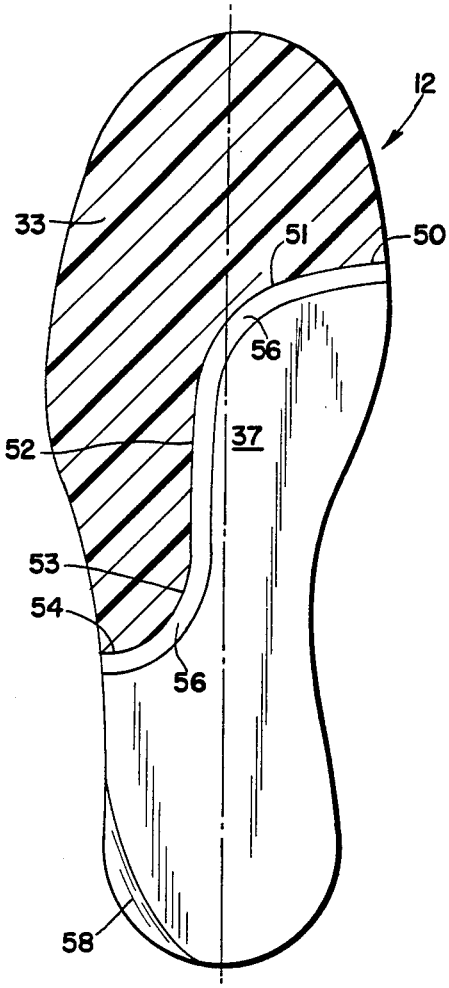
FIG. 3 is a horizontal section taken substantially along lines 3—3 of FIG. 2 and showing the configuration of the stiffening formation according to one embodiment of this invention.
Figure 4:
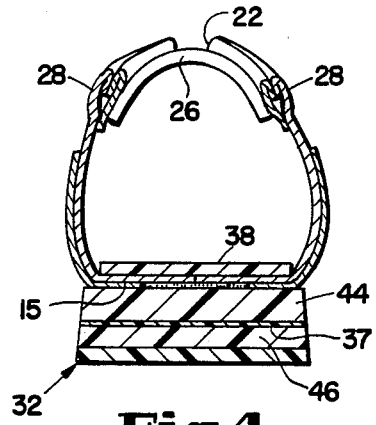
FIG. 4 is a transverse section taken substantially along lines 4—4 of FIG. 2.
Figure 5:
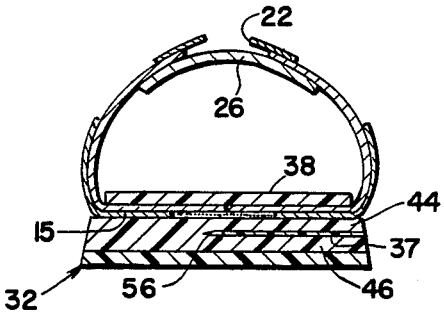
FIG. 5 is a further transverse section taken substantially along lines 5—5 of FIG. 2.

As shown in FIGS. 1–3, the configuration or outline of slit 42 conforms to that of plate 37 to snugly and fully receive the plate. Slit 42 extends throughout the rearfoot or heel portion of midsole 33 so that it opens completely around the midsole's rearfoot portion at the back and also at both sides. From the rearfoot portion of midsole 33, slit 42 extends forwardly along and opens at the inside or medial border of the shoe approximately to the first metatarsal head to underlie the wearer's inside arch.

It will be appreciated that plate 37 may be assembled with midsole 33 in any suitable manner. For example, after slit 42 is formed in the midsole and an adhesive is applied to both sides of plate 37, the plate may be fully inserted into slit 42. The midsole layers 44 and 46 and plate 37 may then be pressed together to firmly adhere the plate to midsole layers 44 and 46.

As shown in FIG. 3, plate 37 extends throughout the rearfoot region of the shoe bottom to the outer edge of the heel and from one side of the midsole to the other. From the rear of midsole 33, plate 37 extends forwardly along the shoe's medial or inside border to the location 50 which is proximal to the wearer's first metatarsal head. From here, the edge or perimeter of plate 37 arcs posteriorly and laterally along a line 51 which is proximal to the wearer's second and third metatarsal heads. The edge of plate 37 then turns to take a direct longitudinally extending line 52 posteriorly to a region underlying the wearer's cuboid where it arcs out at 53 to extend laterally to the lateral or outer border of the shoe bottom along a line 54 lying approximately normal to the shoe's longitudinal axis at the forward end of the midsole's rearfoot or heel section 39.

By the foregoing construction, it is clear that plate 37 underlies the wearer's entire rearfoot and extends forwardly to underlie the wearer's inside arch along the medial border, but not the wearer's outside arch or the forefoot region extending forwardly of the wearer's first, second and third metatarsal heads. Plate 37 stiffens midsole 33 in the sense that midsole 33 is more difficult to flex in the region where the plate lies. Because of the selected area covered by plate 37, however, the plate does not interfere with the required flexure of the shoe for running, walking or other normal activities. Plate 37 therefore may be made as stiff as desired without making it brittle. Plate 37 is considered to be semirigid rather than completely rigid in the sense that under a large enough force it will flex or bend rather than breaking.

Plate 37 is preferably feathered or skived to a taper along its curved, forward edge (see lines 51–54) as indicated at 56 in FIG. 3 to keep the wearer from sensing or feeling an abrupt change in stiffness due to the plate's edge as he presses down on the shoe bottom. Additionally, the rear lateral or outside corner 58 (see FIG. 3) may also be similarly skived to avoid the development of stress concentrations at the most common first heel strike region and also to eliminate or significantly reduce accelerated, deleterious sole wear due to the presence of plate 37.

Plate 37 is formed from any suitable, durable, substantially non-stretchable, stiff material such as a composite sheet of polyester resin containing woven or chopped fiberglass. The amount of fiberglass present in the resin is preferably equal to approximately 25% by volume of the sheet.

Upon impact of the heel on the ground, both of the midsole layers 44 and 46 will compress to absorb energy as the wearer's heel penetrates into the upper midsole layer 44. Because of the configuration of the human heel, the region of the upper midsole layer 44 under the calcaneus will become more highly compressed than the other heel regions of the upper midsole layer. The upper midsole layer 44 will therefore be nonuniformly compressed by the heel load upon impact on the ground. The lower midsole layer 46, however, will be compressed more uniformly because of the stiffness of plate 37.

The stiffness of plate 37 may be judged by the extent to which plate 37 deflects or yields (as by bowing) under a given load. The stiffer plate 37 is, the less it will deflect under a given load.

Accordingly, the stiffer plate 37 is made, the more evenly the wearer's heel load will be distributed over the underlying midsole layer 46 to more uniformly compress layer 46. The more uniformly layer 46 is compressed, the greater will be the reduction in nonuniform or localized degradation of layer 46.

By reducing nonuniform degradation of midsole layer 46, the shoe will remain stable for a longer period of usage, thus lengthening the useful life of the shoe. Preferably, plate 37 is made stiff enough so that it is substantially or virtually unyielding under heel loads at least up to and including a typical peak heel load for normal running. A typical peak heel load for normal running normally exceeds two times an average body weight of about 150 pounds and is considered to be 2½ times the average body weight of about 150 pounds, or 375 pounds. The peak heel load typically occurs under the calcaneus. Plate 37 is therefore stiff enough so that it will not deflect (as by bowing) to anything more than a negligible extent under the typical peak heel load. Deflection of plate 37 is considered to be negligible if the bowed configuration of the plate is not less than a radius of curvature of about 10 inches. Because of the stiffness of plate 37 compression of midsole layer 46 under the wearer's rearfoot will be close to uniform for loads at least up to and including 375 pounds to minimize, if not eliminate, any significant nonuniform degradation of layer 46 due to concentrated vertical force patterns.

The stiffness of plate 37 is dependent upon the plate's modulus of elasticity (or bending modulus, as it is sometimes called) and also upon the plate's thickness. The product of the plate's modulus of elasticity and the cube of the plate's thickness is a measure of the plate's stiffness. This product is hereafter referred to as the stiffness factor.

From the foregoing it will be appreciated that the desired stiffness of plate 37 may be obtained by varying the plate's modulus of elasticity and/or by varying the plate's thickness. Increasing the plate's modulus of elasticity and/or the plate's thickness obviously increases the stiffness of plate 37. Furthermore, the same stiffness may be obtained with different combinations of values of plate thickness and modulus of elasticity.

The thickness of plate 37 should normally be at least approximately 0.05 inches and preferably is 0.06 inches (about 1/16 inch). For the preferred plate thickness of 0.06 inches, the modulus of elasticity should be at least 1,000,000 psi and more preferably is about 2,000,000 psi.

Plate 37 will deflect to no more than a negligible extent under a heel load of about 375 pounds where it is provided with a thickness of about 0.06 inches and a modulus of elasticity of about 1,000,000 psi or with other values of thickness and modulus of elasticity having a stiffness factor approximately equal to the product of 1,000,000 psi and the cube of 0.06 inches.

By providing plate 37 with a stiffness equal to or greater than the foregoing value, midsole layer 46 will function solely as or almost solely as a shock absorber for absorbing the forces resulting from impact of the runner's foot on the ground. The upper midsole layer 44 also acts as a shock absorber for absorbing such forces and additionally cushions the wearer's foot so that the shoe does not feel hard due to the presence of plate 37. Furthermore, the thickness of the upper midsole layer 44 in the region of the wearer's rearfoot or heel is sufficient to cup and closely conform or mold itself to the shape of the wearer's heel to provide additional comfort for the wearer.

Although plate 37 is preferably provided with a relatively high stiffness factor approximately equal to or greater than 216 inch-pounds (i.e., the product of 1,000,000 psi and the cube of 0.06 inches), it will be appreciated that some beneficial reduction in nonuniform or localized midsole degradation may be realized with a lesser stiffness. For example, plate 37 will reduce non-uniform midsole degradation to some meaningful extent even if it is provided with a relatively low stiffening factor of about 20 inch-pounds. However, if plate 37 is provided with a very low stiffness factor appreciably less than 4.0 inch-pounds, it is likely to be too flexible and therefore will not adequately distribute the heel load to provide any significant reduction in nonuniform midsole degradation under the heel.

The extent to which plate 37 is deflectable under a given load depends not only on its stiffness, but also on the thickness of the upper midsole layer 44. Increasing the thickness of midsole layer 44 in the heel region decreases the load concentration under the heel to decrease the extent to which plate 37 will deflect under a given load. Conversely, decreasing the thickness of midsole layer 44 in the heel region increases the load concentration under the heel to increase the extent to which plate 37 will deflect under a given load. If, for example, the midsole is provided with a density of about 0.02 grams per cubic centimeter and the thickness of midsole layer 44 is reduced to about ⅛ inch, plate 37 will deflect significantly under a typical peak heel load of 375 pounds where it is provided with a stiffness factor of about 216 inch-pounds. For the same stiffness factor, the same midsole density and the same load, however, the deflection of plate 37 will be no more than a negligible amount where the thickness of midsole layer 44 is increased sufficiently. Ideally, the stiffness of plate 37 and thickness of midsole layer 44 are selected so that plate 37 will be unyielding and therefore will not deflect under the peak heel load during normal running while maintaining sufficient midsole cushioning under the heel to avoid discomfort to the wearer.

By stiffening midsole 33 with plate 37, the extent of penetration of the runner's foot into the upper midsole layer 44 overlying plate 37 is advantageously and significantly reduced as compared with a conventional shoe without the stiffening formation of this invention. The stiffening effect encountered at initial deformation or penetration of the wearer's foot into the upper midsole layer 44 is approximately doubled by the presence of plate 37 in midsole 33, with the result that energy is absorbed at about twice the rate of a conventional shoe. Although the maximum force will be increased over a new conventional shoe, it nevertheless will still be acceptably low. In addition, conventional shoes are known to frequently lose about half of their energy absorbing properties due to continuous use as, for example, while running a marathon distance.

Reducing the extent of rearfoot penetration into midsole 33 has the advantageous effect of enabling the runner to have greater control over his rearfoot motion, thus improving rearfoot stability without any significant tradeoff of the shock absorbing properties of the midsole 33.

By extending plate 37 to a region where it underlies the runner's inside or medial arch, the composite of midsole 33 and plate 37 underlying the inside arch establishes a comfortable arch support for the wearer which is dynamic in the sense that it is felt only with the application of substantial forces. This eliminates the need for arch cookies or other conventional arch-supporting inserts which are placed in the shoe upper and which disadvantageously reduce the foot-receiving volume of the shoe upper.

Plate 37 acts to reduce midsole degradation in two ways. First, it is sufficiently stiff to effectively disperse or spread out the forces acting on midsole layer 46 throughout the area or region of the plate to thereby provide for a more uniform distribution of the forces acting on midsole layer 46 in the region of the plate. Plate 37 thus eliminates or substantially reduces large, concentrated force patterns resulting from a runner's particular running style and consequently reduces nonuniform degradation of midsole layer 46.

Second, plate 37 has the effect of restraining outward lateral expansion of midsole 33 under the influence of compressive forces because of its adherence to the midsole layers 44 and 46 and because of its substantially non-stretchable properties. The tensile properties of the midsole foam cell walls lying contiguous to the adhesive surfaces will therefore act to restrain the outward expansion under the influence of the compressive forces. While some outward midsole expansion will occur because of these compressive forces, the extent of the outward expansion in each of the midsole layers 44 and 46 will nevertheless be substantially less than the expansion that would take place without the stiffening formation of the present invention. Midsole degradation resulting from such outward expansion is therefore correspondingly reduced with the present invention.

From the foregoing construction, it is important to observe that the plate 37 has the effect of significantly improving the stability of a new running shoe in which no midsole degradation has occurred. In this regard, plate 37 has the effect of dispersing off-centered or unbalanced forces created by a particular running style. Such dispersement produces a restoring force which opposes an unbalanced or off-centered landing of the foot where, for example, the runner lands on the ground along the outside or lateral border of the shoe instead of landing flat. Furthermore, plate 37 provides an improved foot: support during running by employing the midsole layer 44 as a cushion which comfortably conforms to the configuration of the wearer's heel while running and by further establishing a dynamic arch support for the runner's inside or medial arch. In addition to the foregoing, plate 37 significantly reduces nonuniform midsole degradation to substantially improve the stability of the running shoe over the long term and to substantially lengthen the problem-free life of the shoe.

Because the outward expansion of the midsole is restrained just by the non-stretchable or tensile properties of plate 37 and by the adherence of the plate to the midsole layers 44 and 46, such outward midsole expansion may be reduced by using a flexible, preformed, substantially non-stretchable layer or formation in place of plate 37 and by adhering such a non-stretchable flexible formation or layer to the midsole layers 44 and 46.

Instead of being molded in one piece and thereafter slit to accommodate plate 37, midsole 33 may be manufactured with two separately formed foamed layers, and these layers may have different densities. Because of the plate of this invention, different foam materials not previously thought to be suitable for midsoles may be used in the manufacture of the running shoe.

Plate 37 is not required to lie horizontally as shown in FIGS. 1–5. Instead, it may be tilted or rotated in one direction or the other about a longitudinal axis as shown in FIGS. 6 and 7.

Figure 6:
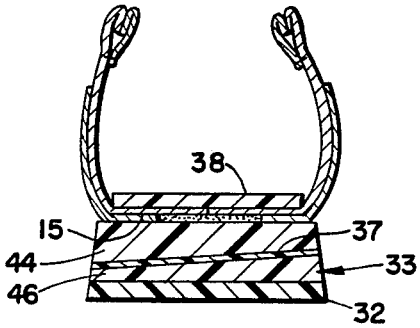
FIG. 6 is a transverse section similar to FIG. 4 but showing a variation which is applicable for runners who pronate excessively.
Figure 7:
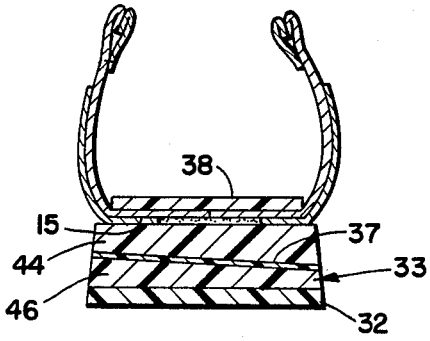
FIG. 7 is another transverse section similar to FIG. 4 but showing a further variation which is applicable to runners who supinate excessively.

In FIG. 6, plate 37 is tilted in a direction to locate its side edge at the lateral or outside shoe bottom border at a level that is lower than its side edge at the medial or inside shoe bottom border to compensate for the forces which are created by runners who pronate excessively. In FIG. 7, plate 37 is tilted in the opposite direction such that the side edge of the plate at the medial or inside shoe bottom border is at a level lower than the opposite side edge at the lateral or outside shoe bottom border to compensate for the forces created by runners who supinate excessively.

The midsole stiffening formation of this invention is not required to be flat or planar as is the case with plate 37. Plate 37 may therefore be replaced with differently shaped stiffening formations. For example, the stiffening formation may have a curved or contoured configuration and it may also be molded. Furthermore, various factors associated with the stiffening formation of this invention may be suitably varied depending upon the circumstances. For example, such factors as the thickness of the stiffening formation, the stiffness of the formation, the geometrical extent or area covered by the stiffening formation, and the placement height of the formation may all be varied to accomodate different running styles, leg and foot asymmetries and body weights.

It also will be appreciated that the stiffening formation of this invention avoids difficult and costly attempts to vary the support pattern of the running shoe by introducing different elastomeric materials into the midsole foam.

Furthermore, the midsole stiffening formation of this invention may advantageously be manufactured separately from the running shoe as a customized product for use by podiatrists and orthopedists for modifying existing or fully constructed shoes after they are manufactured to compensate for leg and foot asymmetries or other problems and to thereby customize the shoe to the individual. For example, the midsole stiffening formation of this invention may be used to compensate for different leg lengths with the added advantage of not requiring the insertion of any parts of components into the shoe upper itself. The method of using the stiffening formation in this manner mainly comprises the steps of first slitting the foamed midsole of an existing athletic shoe or otherwise forming a cavity in the midsole for receiving the stiffening formation, and thereafter inserting the specially formed stiffening formation into the slit or cavity and adhering the stiffening formation to the midsole.

It will be appreciated that the parts of the athletic running shoe for the right foot are the mirror image of the previously described parts of the shoe for the left foot.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A sliplasted athletic shoe comprising a sliplasted upper having a closed fabric bottom, a shoe bottom underlying the upper, and insole overlying the fabric bottom of the upper, said shoe bottom having an outsole coupled to a midsole and said midsole coupled to the fabric bottom of the upper, said midsole comprising an upper and lower midsole layers, each midsole layer is of foam shock absorbing material and a force dispersing substantially thin, planar and stiff plate which includes resin containing fiberglass material positioned between said midsole layers and coupled to each of said midsole layers, said plate extends substantially throughout the rear foot region of the shoe so that when the shoe is worn the plate underlies the entire calcaneus of the wearer's foot.

2. The shoe of claim 1 in which the plate also extends forwardly along the shoes inside portion to underlie the wearer's inside arch but not the outside arch or the forefoot region extending forwardly of the wearer's foot.

3. An athletic shoe comprising an upper having a bottom, a shoe bottom underlying the upper, said shoe bottom having an outsole coupled to a midsole and said midsole coupled to the bottom of the upper, said midsole comprising an upper and lower midsole layers, each midsole layer of foam shock absorbing material and a force dispersing substantially thin and stiff plate positioned between said midsole layers and coupled to each of said midsole layers, said plate extends substantially throughout the rear foot region of the shoe so that when the shoe is worn the plate underlies the entire calcaneus of the wearer's foot.

4. The shoe of claim 3 in which the plate is substantially non-stretchable.

5. The shoe of claim 4 in which the plate extends forwardly above the shoes inside portion to underlie the wearer's foot, but not the outside arch or the forefoot region extending forwardly of the wearer's foot.

6. An athletic shoe comprising an upper having a bottom, a shoe bottom underlying the upper, an insole overlying the bottom of the upper, said shoe bottom having an outsole coupled to a midsole and said midsole coupled to the bottom of the upper, said midsole comprising an upper and lower midsole layers, each midsole layer comprises foam shock absorbing material, and a force dispersing substantially thin, planar and stiff plate which includes resin containing fiberglass material positioned between said midsole layers and coupled to each of said midsole layers, said plate extends substantially throughout the rear foot region of the shoe so that when the shoe is worn the plate underlies the entire calcaneus of the wearer's foot.

7. A sliplasted athletic shoe comprising a sliplasted upper having a closed fabric bottom, a bottom underlying the upper, an insole overlying the fabric bottom of the upper said shoe bottom having an outsole coupled to a midsole and said midsole coupled to the fabric bottom of the upper, said midsole comprising an upper and lower midsole layers, each midsole layer comprising foam shock absorbing material and a force dispersing substantially thin and stiff plate positioned between said midsole layers and coupled to each of said midsole layers, said plate extends substantially throughout the rear foot region of the shoe so that when the shoe is worn the plate underlies the entire calcaneus of the wearer's foot.

8. The shoe of claim 7 in which the plate also extends forwardly along the shoe's inside portion to underlie the wearer's inside arch but not the outside arch or the forefoot region extending forwardly of the wearer's foot.

9. A sliplasted athletic shoe comprising a sliplasted upper having a closed fabric bottom, a bottom underlying the upper, said shoe bottom having an outsole coupled to a midsole and said midsole coupled to the fabric bottom of the upper, said midsole comprising an upper and lower midsole layers, each midsole layer of foam shock absorbing material and a force dispersing substantially thin, planar and stiff plate material positioned between said midsole layers and coupled to each of said midsole layers, said plate extends substantially throughout the rear foot region of the shoe so that when the shoe is worn the plate underlies the entire calcaneus bone of the wearer's foot, said plate extends forwardly along the shoe's inside portion to underlie the wearer's inside arch but not the outside arch or the forefoot region extending forwardly of the wearer's foot.

10. The shoe of claim 9 in which the plate is substantially non-stretchable.

* * * * *